US005211607A

United States Patent [19]

Fermaglish et al.

[11] Patent Number: 5,211,607

[45] Date of Patent: May 18, 1993

[54] BABY ACTIVITY CENTER

[76] Inventors: Daniel R. Fermaglish; Lois F. Fermaglich, both of 9 Van Duyne Rd., Mountain Lakes, N.J. 07046

[21] Appl. No.: 821,993

[22] Filed: Jan. 16, 1992

Related U.S. Application Data

[63] Continuation-in-part of Ser. No. 528,724, May 24, 1990, Pat. No. 5,085,428.

[51] Int. Cl.[5] ..... H63B 23/06

[52] U.S. Cl. ..... 472/15; 482/69

[58] Field of Search ..... 472/15; 482/66–69; 135/67; 297/135, 275, 276

[56] References Cited

U.S. PATENT DOCUMENTS

| | | | |
|---|---|---|---|
| 451,128 | 4/1891 | Lawson | 472/15 X |
| 839,681 | 12/1906 | Voight, Sr. . | |
| 875,377 | 12/1907 | Pillia et al. . | |
| 1,437,179 | 4/1922 | Herson | 472/15 |
| 1,469,436 | 10/1923 | Fornia | 472/15 |
| 2,198,813 | 4/1940 | Hall . | |
| 2,665,742 | 1/1954 | Starysky . | |
| 2,697,478 | 12/1954 | McKinney . | |
| 2,816,543 | 1/1954 | Henry | 472/15 |
| 2,910,111 | 10/1959 | Hansburg . | |
| 3,049,350 | 8/1962 | Walker | 472/15 |
| 3,127,170 | 3/1964 | Caster . | |
| 3,130,814 | 4/1964 | Del Aquila . | |
| 3,279,567 | 10/1966 | Kempel . | |
| 3,454,272 | 7/1969 | Elkington et al. . | |
| 3,747,596 | 7/1973 | Mills . | |
| 4,204,673 | 5/1980 | Speer, Sr. . | |
| 4,334,695 | 6/1982 | Ashby . | |
| 4,743,008 | 5/1988 | Fermaglich et al. . | |
| 5,085,428 | 2/1992 | Fermaglich et al. | 472/15 |

FOREIGN PATENT DOCUMENTS

| | | |
|---|---|---|
| 734490 | 1/1932 | France . |

*Primary Examiner*—Richard E. Chilcot, Jr.
*Attorney, Agent, or Firm*—Ralph W. Selitto, Jr.

[57] ABSTRACT

An infant walker adapted for use in a substantially stationary location has a frame or base and an infant seat attached thereto such that it can be manually or automatically revolved in an orbital manner. The seat can also rotate about its own axis of rotation, whereby an infant who is in the seat can walk along a circular path and/or turn in place. The seat can also reciprocate in an up and down fashion to permit an infant seated therein to jump up and down.

32 Claims, 9 Drawing Sheets

BABY ACTIVITY CENTER

CROSS-REFERENCE TO RELATED APPLICATION

This is a continuation-in-part of our prior application Ser. No. 07/528,724, filed May 24, 1990, now U.S. Pat. No. 5,085,428.

FIELD OF THE INVENTION

The present invention relates, in general, to an infant walker, and, more particularly, to an improved infant walker which permits an infant to exercise its legs while the walker remains stationary, and which also functions as a feeder and/or activity center.

BACKGROUND OF THE INVENTION

Devices which allow an infant to exercise its legs and practice walking have been proposed in the past. For instance, U.S. Pat. No. 4,743,008 discloses an infant exerciser which is horizontally supported by legs in a central opening of an annular tray and a treadmill assembly is suspended from the seat. An infant placed in the seat is thus able to move its legs in a walking motion on the treadmill and is able to change its field of view.

U.S. Pat. No. 839,681 discloses a baby walker in which a seat is slidably mounted on guide rails supported on a stationary frame. A baby seated in the seat can walk from one end of the guide rails to an opposite end on a fastboard or treadway. Such a device, however, is adapted for unidirectional travel only. That is, once the baby reaches the end of the treadway, the seat must be returned to the other end, thereby requiring assistance from older children or adults. Also, the baby cannot turn around or change its field of view while seated.

U.S. Pat. No. 875,377 discloses a baby walker in which a seat is rotatably mounted on a carriage adapted to move back and forth along a pair of support rods. A baby seated in the seat can walk from one of the support rods to the other end on a platform. Once the baby reaches the opposite end of the platform, he or she can turn the seat around and then walk back to the other end. Because the baby actually walks in a rectilinear fashion along the platform, the baby walker is, out of necessity, comparatively large and cumbersome. Although the mobility of the baby walker is enhanced by trucks (i.e., roller assemblies) provided at the bottom of the walker, such mobility poses a potential hazard in that the walker can be accidentally or unintentionally moved close to stairs or dangerous appliances, such as stoves and heaters.

U.S. Pat. No. 3,127,170 discloses a children's play table with a chair attached to a base. The chair can rotate about the central vertical axis of the table. However, because the chair is secured to a horizontal support rod by screws, the chair is prevented from rotating or spinning about an axis of rotation passing through the center of the chair. Also, while an infant seated in the chair is able to pull and push the chair around the table, the infant can not actually walk while seated in the chair.

SUMMARY OF THE INVENTION

In accordance with the present invention, a new and improved infant walker has at least one seat which is revolvably and rotatably mounted relative to a stationary frame or base. More particularly, the seat is sized and shaped so as to permit an infant to sit thereon or to stand therein with its feet on the floor below. The seat is rotatably mounted such that it can be spun about its own axis. The seat can also revolve (i.e., orbit) about a vertical axis of the frame or base. Thus, an infant placed in the seat can practice walking by changing its physical location, simultaneously changing its field of view to orient itself to interact with the surrounding environment, and yet be denied the mobility to encounter the potentially hazardous situations discussed hereinabove.

In one embodiment, the infant walker has two rotatable seats: an outer seat positioned at the periphery of an annular tray and an inner seat positioned in a central opening of the annular tray. Thus, two infants may exercise simultaneously: one infant in the outer seat and another infant in the inner seat. The infant in the outer seat can walk along a predetermined circular path and can rotate or spin at a number of different points along that path. The infant in the inner seat can rotate the seat, but can not walk along a circular path or any other path. The walker may be arranged such that the inner and outer seats move independently of one another. Alternatively, the seats may move conjointly. That is, the inner seat will rotate as the outer seat revolves around the frame, or vice versa. Thus, in a situation where one infant is old enough to practice walking and a second infant is younger, the movements of the older infant in either seat can move the seat in which the younger infant is placed.

In another embodiment, the seat or seats of the infant walker are resiliently suspended so as to allow an infant to jump up and down while seated. The resilient suspension of the seat or seats can be accomplished by, for instance, a plurality of springs.

BRIEF DESCRIPTION OF THE DRAWINGS

For a more complete understanding of the present invention, reference may be had to the following detailed description considered in conjunction with the accompanying drawings, in which.

DETAILED DESCRIPTION OF THE EXEMPLARY EMBODIMENTS

Figure 1:
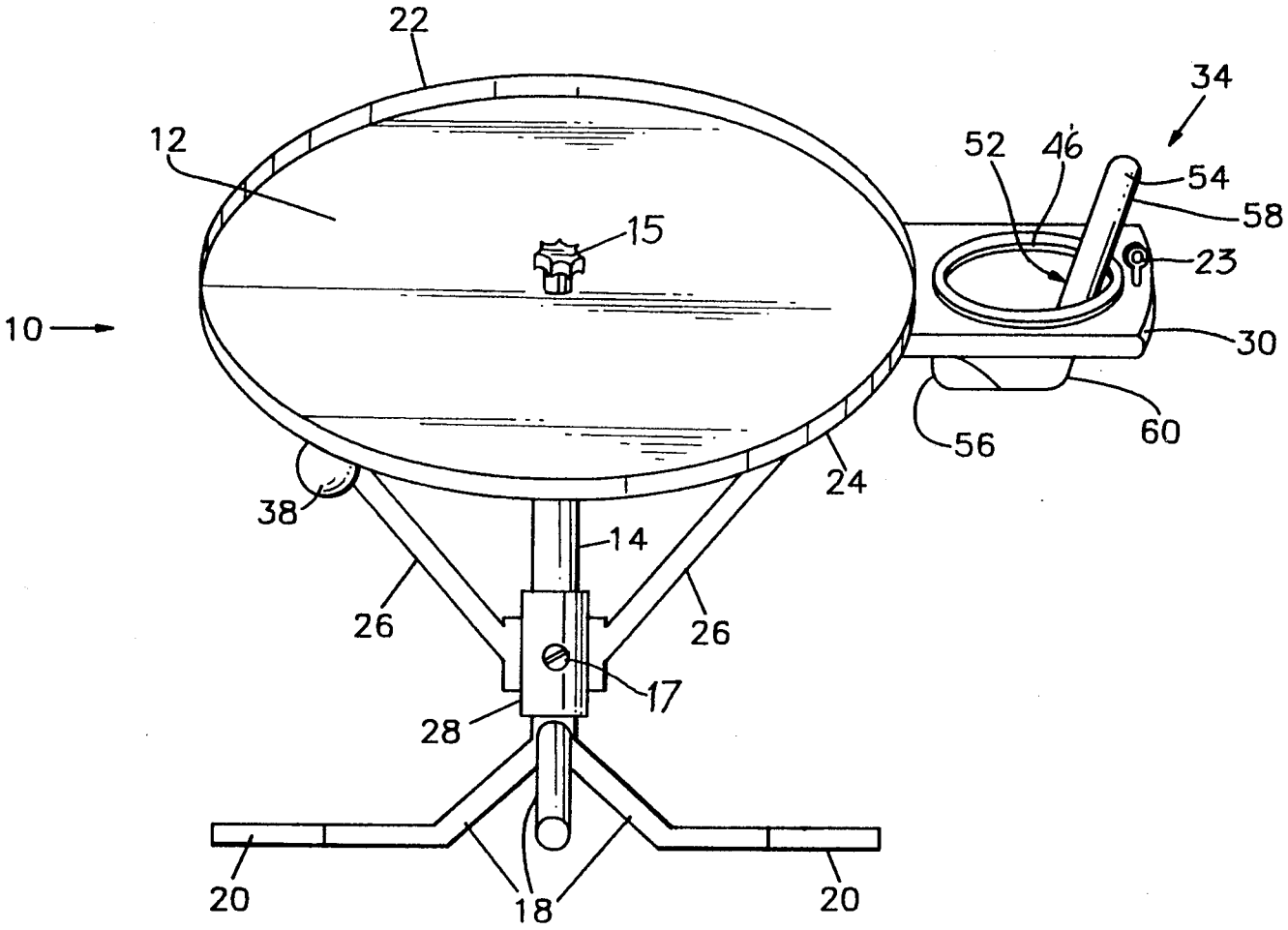
FIG. 1 is a perspective view of an improved infant walker constructed in accordance with one exemplary embodiment of the present invention.
Figure 2:
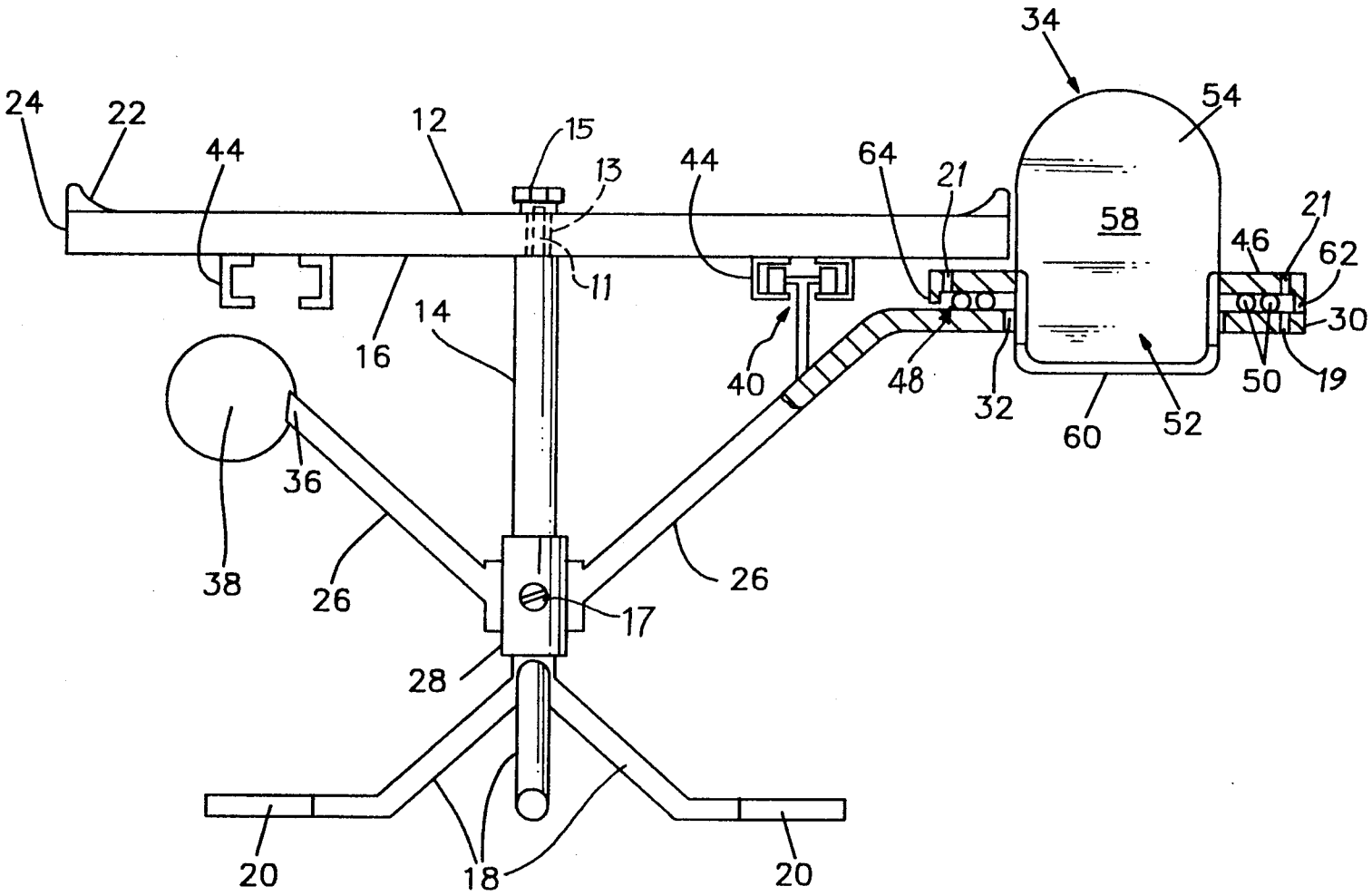
FIG. 2 is an elevational view of the infant walker illustrated in FIG. 1, a portion of the infant walker being shown in cross section to facilitate consideration and discussion.

Referring to FIGS. 1 and 2, an infant walker 10 has a circular tray 12 which is arranged in a substantially horizontal orientation relative to the floor or other support surface. The tray 12 is supported by an adjustable vertical support rod 14. The vertical support rod 14 depends from a bottom surface 16 of the tray 12 and terminates in legs 18. Each leg 18 is equipped with non-skid pads or feet 20 in order to inhibit the accidental or inadvertent movement of the infant walker 10 across the floor or other support surface. The height of the support rod 14 is adjustable by conventional adjusting means, such as a telescoping arrangement, so that the walker 10 may be lowered or raised as required in order to allow the feet of an infant seated therein to touch the floor or other support surface. Additionally, the support rod 14 may be releasably fastened to the bottom surface 16 of the tray 12 by, for instance, providing the support rod 14 with a spindle 11, which extends upwardly through a central opening 13 in the tray 12 and which threadedly engages a manually operable lock knob 15. When the lock knob 15 is tightened, it presses the tray 12 against the support rod 14 with a force sufficient to prevent the tray 12 from rotating about the spindle 11. When the lock knob 15 is loosened, the tray 12 is free to rotate about the spindle 11 for a purpose to be described hereinafter. If the lock knob 15 is removed from the spindle 11, the tray 12 can be removed from the support rod 14, thereby facilitating storage and transportation of the walker 10.

The tray 12 has an outer circumferential ridge 22, which extends upwardly from an outer circumferential edge 24 of the tray 12 for a purpose to be described hereinafter. Such items as infant toys, food, and books can be placed on the tray 12.

Figure 3:
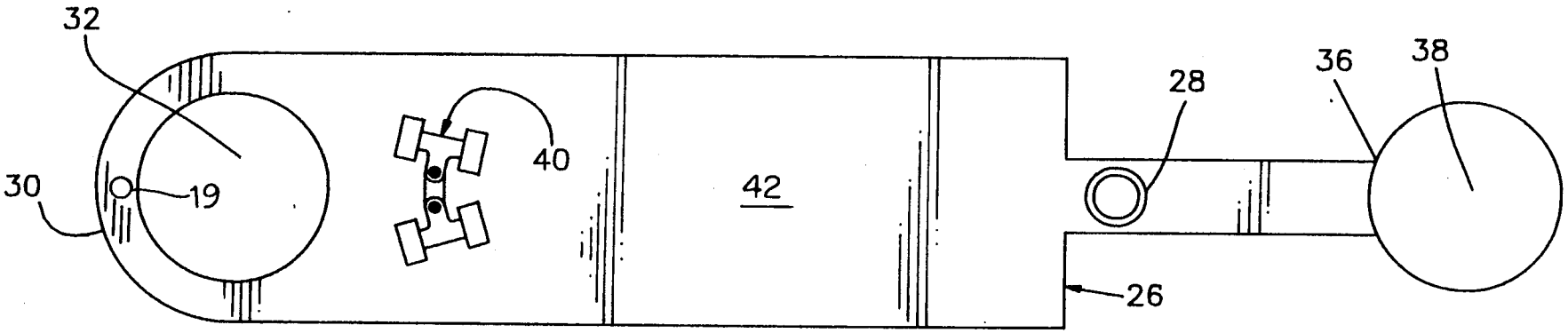
FIG. 3 is a top plan view showing a portion of a mounting assembly employed by the infant walker illustrated in FIGS. 1 and 2.
Figure 4:
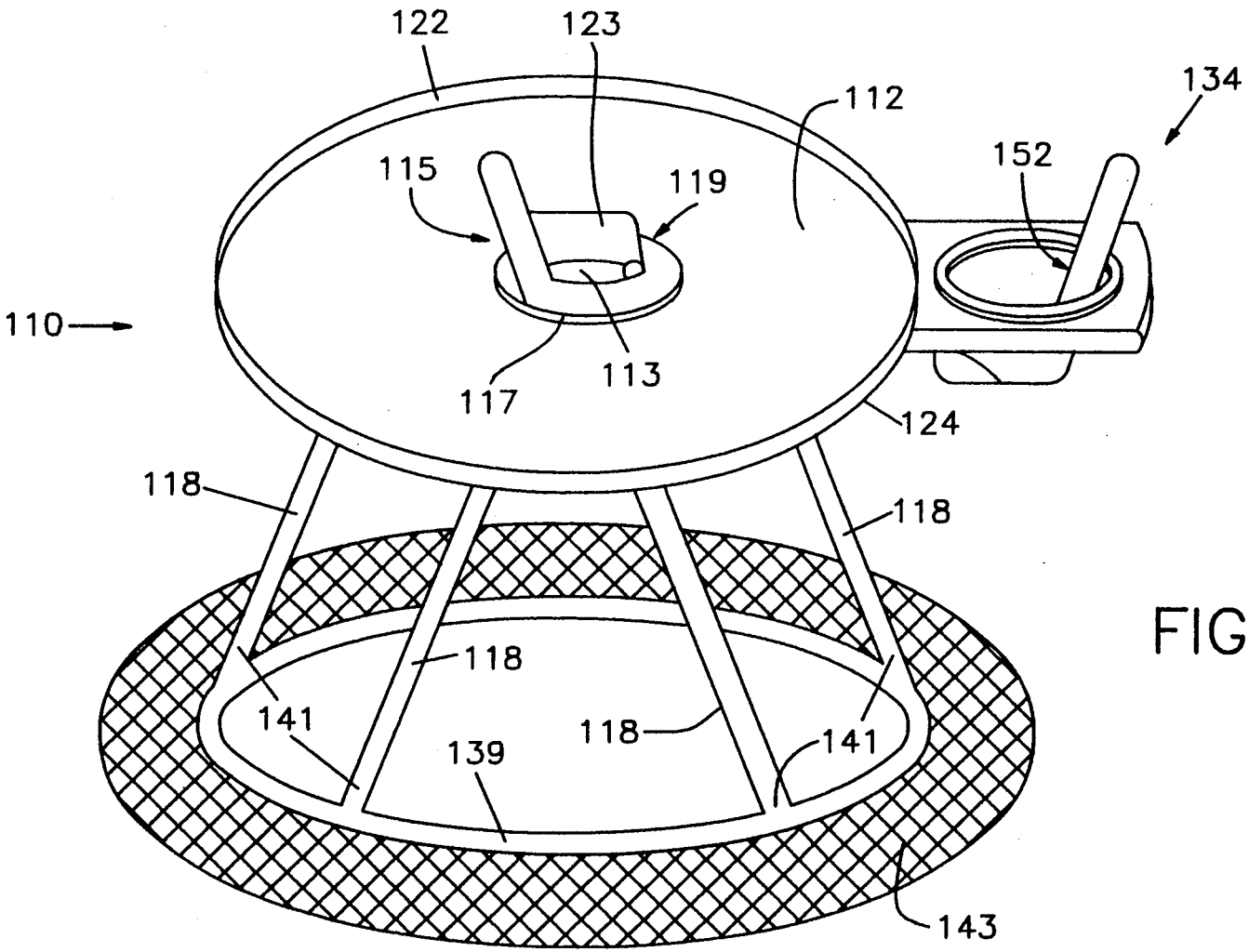
FIG. 4 is a perspective view of an improved infant walker constructed in accordance with another exemplary embodiment of the present invention.

Referring to FIGS. 2 and 3, the infant walker 10 has a mounting arm 26 with a sleeve 28, which is rotatably mounted on the support rod 14 and which is provided with a set screw 17 adapted to prevent relative rotation between the sleeve 28 and the support rod 14 when tightened, thereby locking the mounting arm 26 in place. A first end 30 of the mounting arm 26 has a seat opening 32, which receives a seat assembly 34, and a lower guide hole 19, which has a function to be described hereinafter. A second end 36 of the mounting arm 26 has a counterweight 38 attached thereto. The counterweight 38 prevents an infant placed in the seat assembly 34 from tipping the walker 10. A caster assembly 40, attached to an upper surface 42 of the mounting arm 26, is positioned between the sleeve 28 and the seat opening 32. The caster assembly 40 is received in an annular caster track 44, which is removably attached to the bottom surface 16 of the tray 12, such that the caster assembly 40 can move freely therein.

Referring to FIGS. 1–3, the seat opening 32 is sufficiently large to accommodate the seat assembly 34. An annular collar 46 extends around the seat opening 32 and is attached to the seat assembly 34, the collar 46 thereby enabling the seat assembly 34 to be suspended in the seat opening 32. The collar 46 rests on an annular roller bearing race 48, which includes two concentric rows of ball bearings 50. Both the collar 46 and the bearing race 48 have an inner diameter about as large as that of the seat opening 32. The collar 46 is provided with a plurality of upper guide holes 21, each of which can be individually aligned with the lower guide hole 19 of the mounting arm 26. When one of the upper guide holes 21 is brought into alignment with the lower guide hole 19, an eye pin 23 (see FIG. 1) can be inserted therethrough for a purpose to be described hereinafter.

The seat assembly 34 includes an infant seat 52, which is attached to the collar 46. The seat 52 includes a substantially rigid backrest 54 adapted to support the back of an infant and a flexible strap 56 adapted to support the infant's buttocks and crotch while permitting the infant's legs to straddle the strap 56 on opposite sides thereof. More particularly, a back side 58 of the backrest 54 is connected to the collar 46, while the strap 56 extends from a lower end 60 of the backrest 54 to attach to the collar 46 at a point diametrically opposite to the point where the backrest 54 is attached to the collar 46. A flange 62 extends downwardly from the outer edge 64 of the collar 46 and has an outer curvature which matches that of the roller bearing race 48. The flange 62 helps maintain the position of the ball bearings 50 in the roller bearing race 48. The locking mechanism (not shown) might, for example, be of the racheting variety adapted to engage teeth (not shown) formed on the flange 62. Such a ratchet lock could also be designed to selectively permit rotation of the seat 52 in one direction only.

In use, an infant is placed in the seat 52 after the height of the support rod 14 has been adjusted to permit the infant's feet to contact the floor or other support surface. The infant is then free to exercise or walk around the tray 12, which remains stationary because the legs 18 immovably engage the floor or other support surface. As the infant otherwise walks or exercises, he or she can grip the ridge 22 of the tray 12 and rotate (i.e., spin) the seat 52 relative to the mounting arm 26 in a complete circle (i.e., a full 360 degrees), thereby permitting the infant to better interact with its surrounding environment and to associate the walking movements with changing its location.

The infant walker 10 can also be used as a feeder and/or activity center by tightening the set screw 17 in order to immobilize the mounting arm 26. With the mounting arm 26 locked in place by the tightened set screw 17, the eye pin 23 may be inserted through an appropriate one of the upper guide holes 21 and into the lower guide hole 19 so as to lock the seat assembly 34 in a position in which the infant seat 52 faces the tray 12 (see FIG. 1). By loosening the lock knob 15, the tray 12 could then be rotated about the spindle 11 by an infant seated in the infant seat 52, whereby articles arranged at different locations on the tray 12 could be selectively accessed by the infant.

Three alternate embodiments of improved infant walkers constructed in accordance with the present invention are illustrated in FIGS. 4–7; FIG. 8; and FIGS. 9–11, respectively. Elements illustrated in FIGS. 4–7; FIG. 8; and FIGS. 9–11 which correspond to the elements described above with respect to FIGS. 1–3 have been designated by corresponding reference numerals increased by 100, 200, and 300, respectively. New elements illustrated in FIGS. 4–7; FIG. 8; and FIGS. 9–11 which have no counterparts in FIGS. 1–3 are designated with odd reference numerals. The embodiments of FIGS. 4–7; FIG. 8; and FIGS. 9–11 operate in the same manner as the embodiment of FIGS. 1–3 unless otherwise stated.

With reference to FIGS. 4–7, an improved infant walker 110 includes an annular tray 112 with a central opening 113 therein. In addition to a peripheral seat assembly 134, the walker 110 is provided with a central seat assembly 115. The tray 112 has an inner circular ridge 117, which extends upwardly from an inner supporting ring 119 of the tray 112 for a purpose to be described hereinafter. An outer ridge 122 extends upwardly from an outer edge 124 of the tray 112 for a purpose to be described hereinafter. An annular caster track 144 (see FIG. 6) is attached to a bottom surface 116 of the tray 112.

Figure 5:
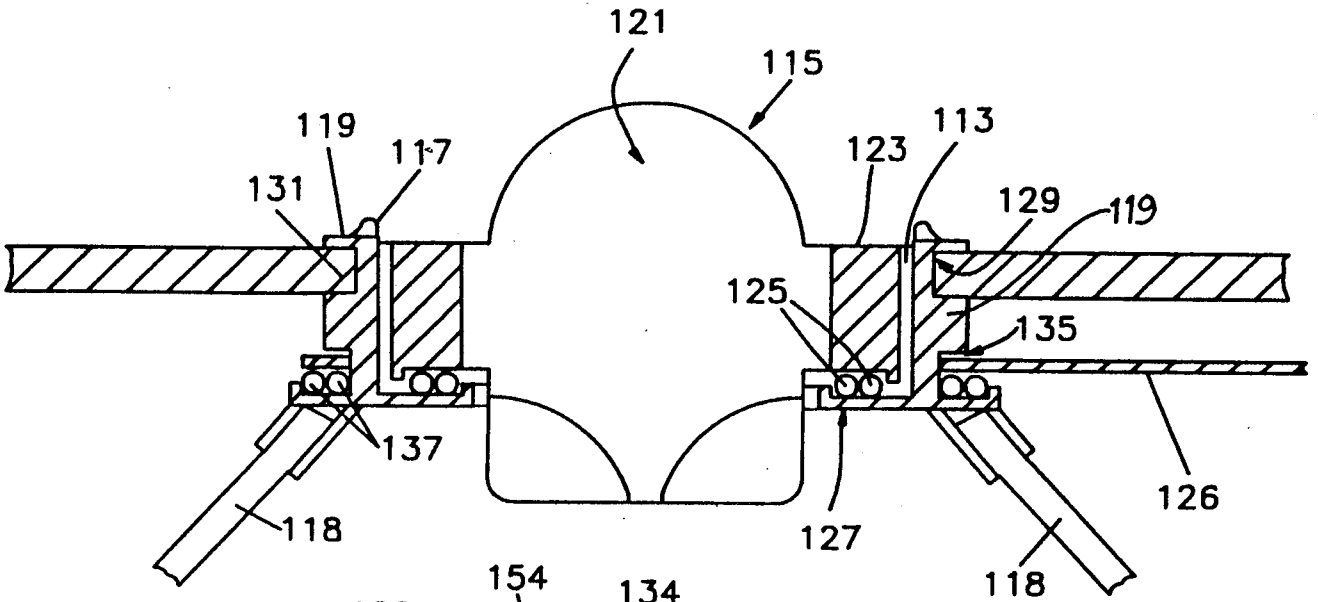
FIG. 5 is a cross-sectional view showing, in detail, a central rotating seat assembly which forms a part of the infant walker shown in FIG. 4.
Figure 6:
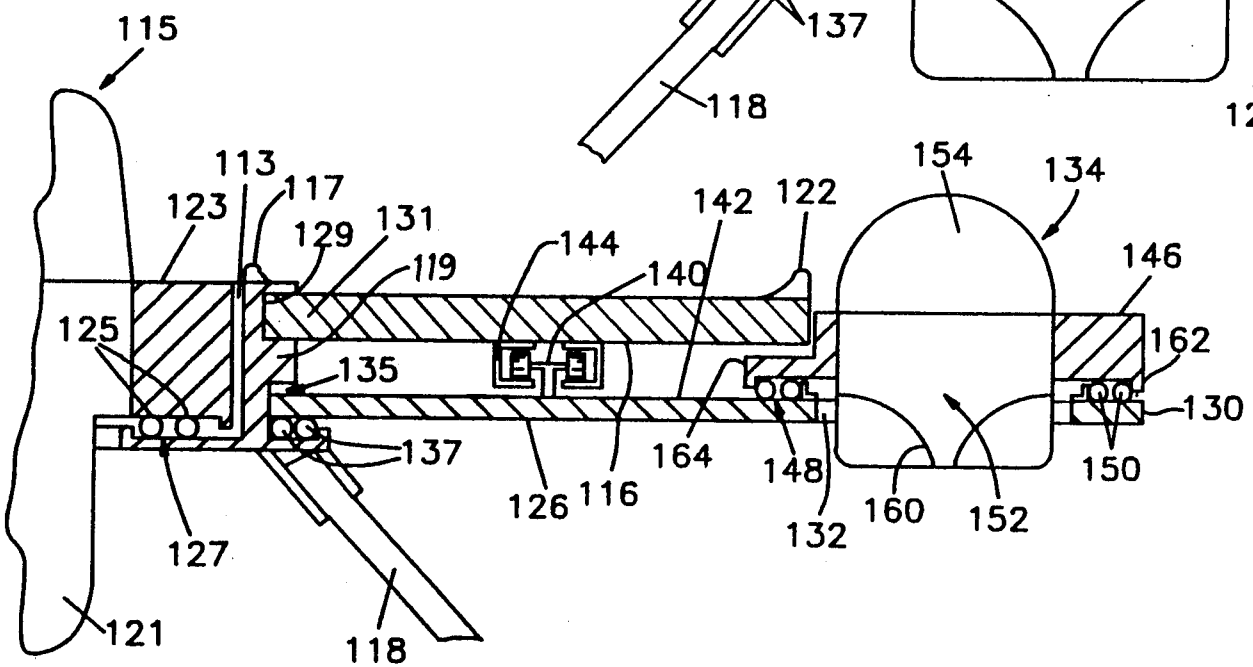
FIG. 6 is a cross-sectional view showing, in detail, a peripheral rotating seat assembly which forms a part of the infant walker, shown in FIG. 4.

Referring to FIG. 5, the central seat assembly 115 includes a seat 121 which is attached to an annular collar 123 adapted to roll on two concentric rows of ball bearings 125 housed in an annular roller bearing race 127 set in the support ring 119. The support ring 119 is mounted and secured in the central opening 113 by an upper annular slot 129 sized and shaped so as to receive an inner edge 131 of the tray 112.

Legs 118 depend from the support ring 119 so as to maintain the tray 112 in a substantially horizontal orientation above a floor or other support surface. The height of the legs 118 is adjustable by conventional adjusting means, such as a telescoping arrangement, so that the walker 110 may be lowered or raised as required in order to allow the feet of the infant seated therein to touch the floor or other support surface. Additionally, the legs 118 may be releasably fastened to the support ring 119 by conventional fastening means (not shown) to allow for simple and rapid assembly and disassembly, thereby facilitating storage and transportation of the walker 110.

Figure 7:
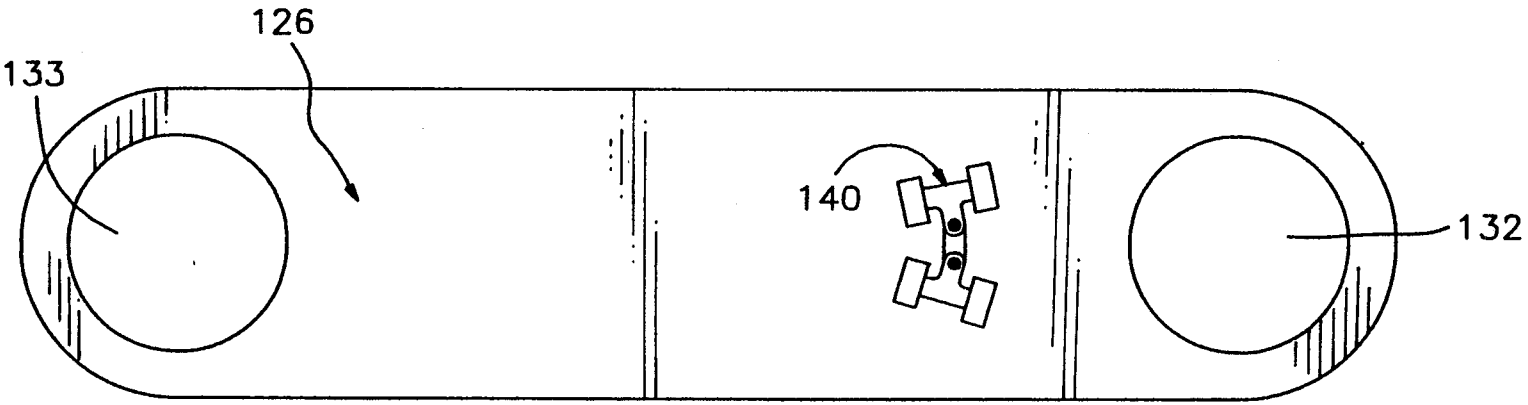
FIG. 7 is a top plan view showing a mounting assembly which forms a part of the infant walker shown in FIGS. 4–6.
Figure 8:
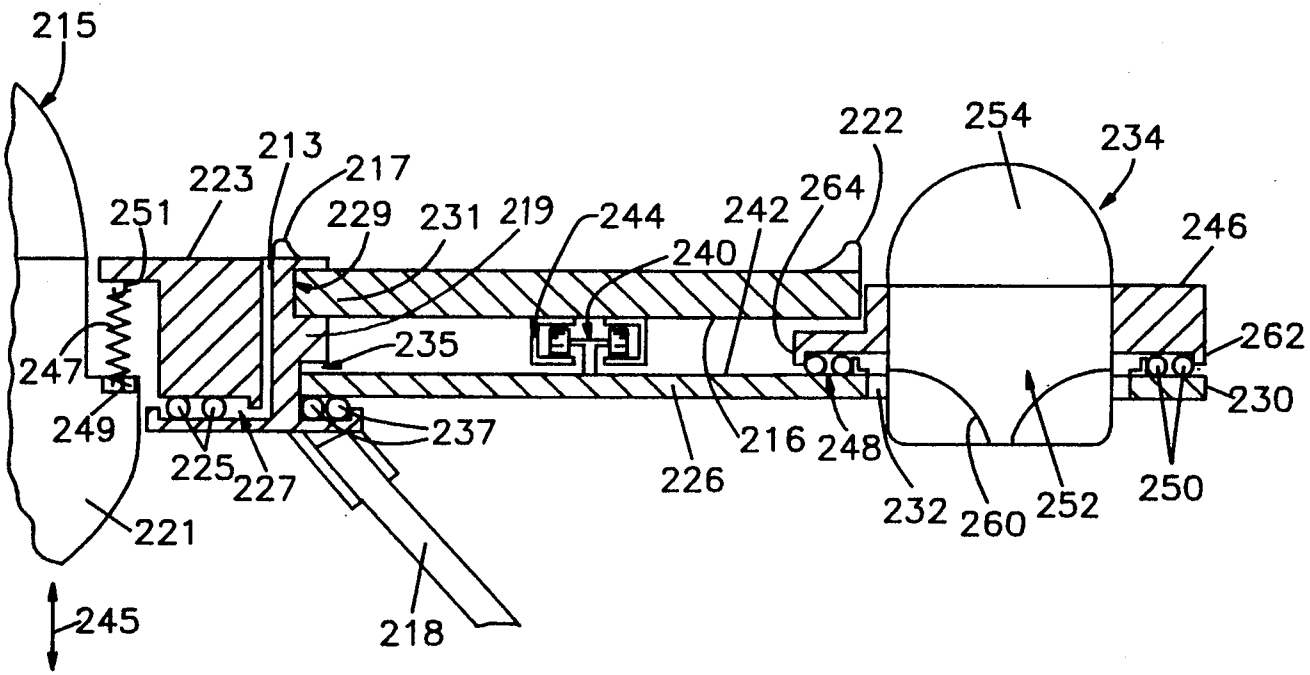
FIG. 8 is a cross-sectional view, similar to that of FIG. 6, showing a modified version of the infant walker illustrated in FIGS. 4–7.

A mounting arm 126 has an inner seat opening 133 and an outer seat opening 132 (see FIG. 7). The diameter of the inner seat opening 133 is selected such that the mounting arm 126 is captured in a lower annular slot 135 of the support ring 119, the slot 135 being provided with two concentric rows of ball bearings 137 adapted to facilitate the rotation of the mounting arm 126 about the support ring 119. A caster assembly 140, attached to an upper surface 142 of the mounting arm 126, is received in the annular caster track 144. The outer seat opening 132 is sized to receive a peripheral seat assembly 134, which includes an infant seat 152.

In use, the height of the legs 118 is adjusted to permit the infant's feet to contact the floor or other support surface. If it is desired, an infant may be placed in the peripheral seat assembly 134 thereby allowing him or her to exercise o walk freely around the stationary legs 118 which immovably engage the floor or other support surface. As the infant walks or otherwise exercises, he or she can grip the ridge 122 of the tray 112 and rotate the seat 152 relative to the central axis of the outer seat opening 132, thereby permitting the infant to better interact with its surrounding environment and to associate the walking movements with changing its location. Alternatively, it may be desirable to place an infant in the central seat assembly 115, thereby further limiting the extent to which the infant can move without totally denying him or her of the ability to exercise by rotating the seat 121 with his or her legs and/or hands. More particularly, the infant can grip the inner ridge 117 or use its feet against the floor or other support surface to rotate the seat 121 relative to the central axis of the inner seat opening 133.

The tray 112 also serves as a table surface on which to place the infant's playthings or food. To feed the infant in either the seat 121 or the seat 152, the seats 121 and 152 may be immobilized by engaging corresponding lock mechanisms (not shown). Additionally, an infant may be placed in each of the seats 121 and 152 at once. The walker 110 may be constructed so that a user can select a setting which causes the seats 121 and 152 to turn independently or conjointly (i.e., when an infant spins the seat 121, then the seat 152 revolves about the frame, and vice versa.)

The possibility that a lone infant in the seat 152 may tip the walker 110 can be obviated by providing an annular base 139 for connecting lower ends 141 of the legs 118 to one another. The base 139 is parallel to the tray 112 and to the floor or support surface. The base 139 includes a textured walkway 143, which provides traction and a clean even surface for the infant to walk on as well as serving to more evenly distribute the infant's weight.

Referring to FIG. 8, an improved infant walker 210 has a central seat assembly 215 and a peripheral seat assembly 234. The walker 210 and the seat assemblies 215 and 234 operate in the same manner as their counterparts in the embodiment of FIGS. 4–7 except that a seat 221 of the seat assembly 215 is adapted for reciprocating movement in a vertical direction so that an infant seated therein can jump up and down as indicated by arrow 245. The ability of the seat 221 to reciprocate in a vertical direction is provided by springs 247 (only one of which can be seen in FIG. 8) stretched between hooks 249 attached to the seat 221 and hooks 251 attached to an annular collar 223. While the seat assembly 234 is not adapted for reciprocating movement in a vertical direction, it should be understood that appropriate modifications could be made to impart such movement to the seat assembly 234.

Figure 9:
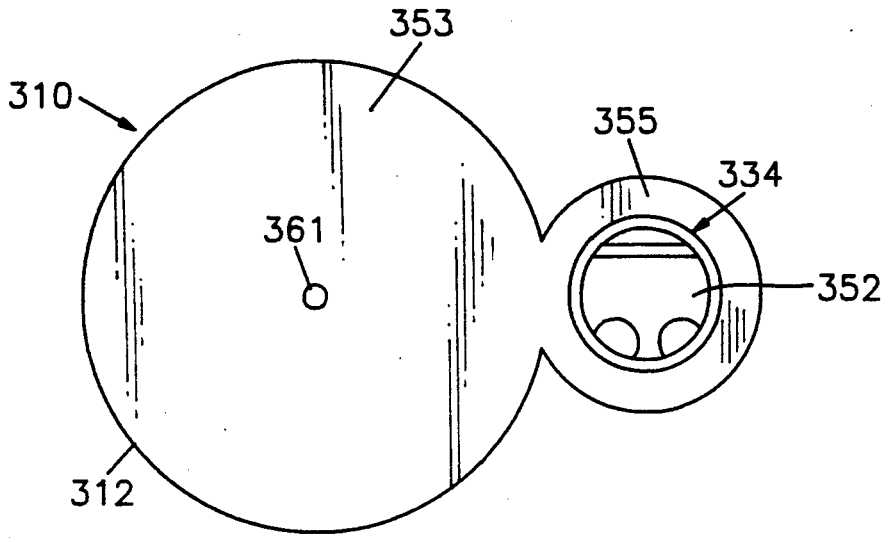
FIG. 9 is a top plan view of an improved infant walker constructed in accordance with still another exemplary embodiment of the present invention.
Figure 10:
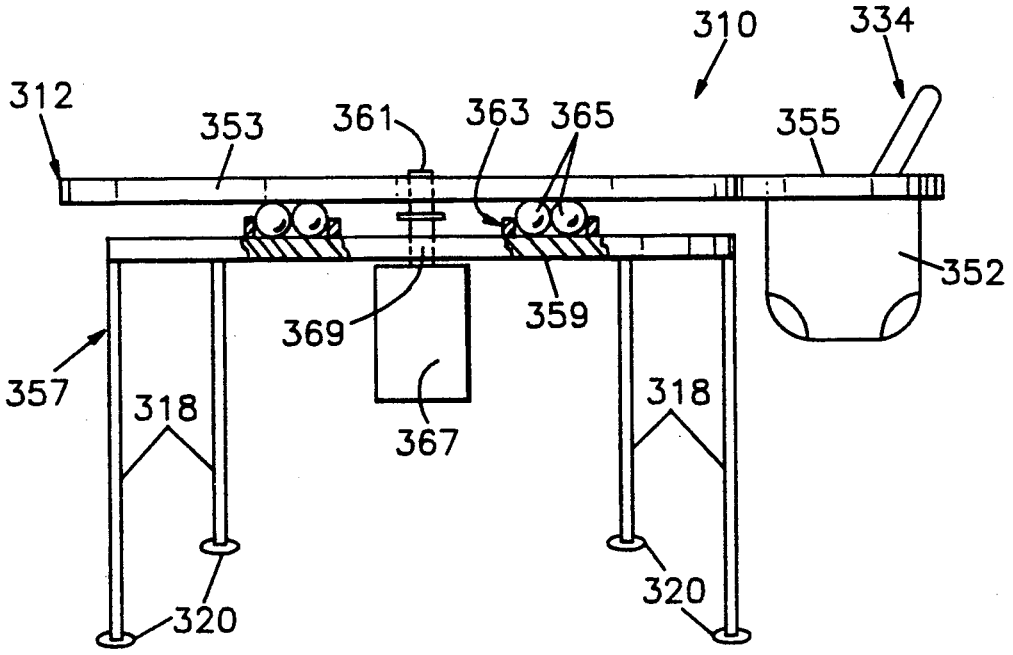
FIG. 10 is an elevational view of the infant walker illustrated in FIG. 9.
Figure 11:
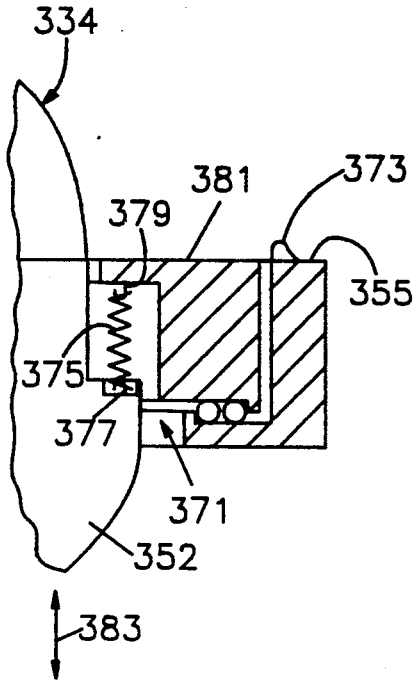
FIG. 11 is a cross-sectional view showing, in detail, a rotating seat assembly which forms a part of the infant walker illustrated in FIGS. 9 and 10.

Referring now to FIGS. 9–11, an improved infant walker 310 includes a tray 312 having an inboard section 353 and an outboard section 355 which are formed monolithically or otherwise integrally so that the inboard and outboard sections 353 and 355 rotate conjointly relative to a stationary mounting assembly 357. The mounting assembly 357 includes a support plate 359 having legs 318 depending therefrom so as to maintain the tray 312 in a substantially horizontal orientation above a floor or some other support surface. Each leg 318 is equipped with non-skid pads or feet 320 in order to inhibit the accidental or inadvertent movement of the infant walker 310. The height of the legs 318 is adjustable by conventional adjusting means, such as a telescoping arrangement, so that the walker 310 may be lowered or raised as may be required in order to allow the feet of the infant seated therein to touch the floor or other support surface. Additionally, the legs 318 may be releasably fastened to the support plate 359 by conventional fastening means (not shown) to allow for simple and rapid assembly and disassembly, thereby facilitating storage and transportation of the walker 310. The support plate 359 has a central spindle 361 and an annular roller bearing race 363, which is provided with ball bearings 365. The spindle 361 and the ball bearings 365 support the tray 312 for rotation about a vertical axis defined by the spindle 361. An electric motor 367, or any other suitable type of motor, has an output shaft 369, which is attached to the spindle 361 for a purpose to be described hereinafter.

The outboard section 35 of the tray 312 is provided with a circular seat opening 371 (see FIG. 11) surrounded by an annular ridge 373 which extends upwardly from the outboard section 355 for a purpose to be described hereinafter. A seat assembly 334 is rotatably mounted in the seat opening 371. Springs 375 (only one of which can be seen in FIG. 11), which are stretched between hooks 377 attached to a seat 352 and hooks 379 attached to an annular collar 381, provide the seat 352 with the ability to reciprocate in a vertical direction as indicated by arrow 383.

In use in a manual mode of operation, an infant is placed in the seat assembly 33 after the height of the legs 318 has been adjusted to permit the infant's feet to contact the floor or other support surface. The motor 367 would remain deactivated so that the infant is free to exercise or walk around the mounting assembly 357, which remains stationary as the tray 312 rotates because the legs 318 of the mounting assembly 357 immovably engage the floor or other support surface. The infant can also rotate (i.e., spin) the seat assembly 334 relative to its central axis in a complete circle (i.e., a full 360 degrees), thereby permitting the infant to better interact with its surrounding environment and to associate the walking movements with changing its location. The infant can accomplish such rotation by gripping the ridge 373 or by using its feet against the floor or other support surface. It is also possible for the infant to bounce up and down while he or she is seated in the seat assembly 334.

In an automatic mode of operation, the height of the legs 318 would be adjusted to prevent the infant's feet from contacting the floor or other support surface. The motor 367 would then be activated to cause the rotational movement of the output shaft 369, which in turn would rotate the spindle 361 and hence the tray 312. The automatic mode of operation does, of course, permit the infant seated in the seat assembly 334 to orbit the mounting assembly 357. While the infant could also spin in the seat assembly 334, bouncing up and down would be inhibited due to the fact that the infant's feet are not in contact with the floor or other support surface.

Figure 12:
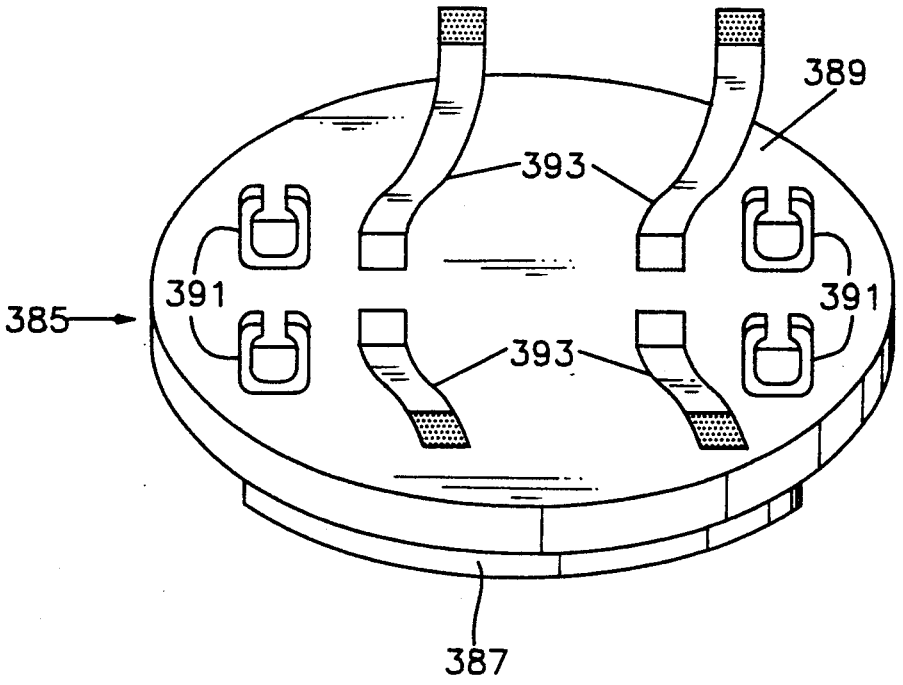
FIG. 12 is a perspective view of an attachment for the infant walker illustrated in FIGS. 9–11.

By disengaging the springs 375 from their associated hooks 377 and 379, the seat assembly 334 could be removed from the seat opening 371 and replaced by a cover plate 385 (see FIG. 12) having a male-type plug 387 sized and shaped so as to be received within the opening 371. An upper surface 389 of the cover plate 385 is equipped with resilient snap-type clips 391 and straps 393 (or any other suitable type of fastener) to permit an infant car seat or the like to be releasably fastened to the cover plate 385 and hence to the tray 312.

It will be understood that the embodiments described herein are merely exemplary and that a person skilled in the art may make many variations and modifications without departing from the spirit and scope of the invention. For example, the seat assembly 34 could be modified so that the seat 52 is adapted for reciprocating movement in a vertical direction, whereby an infant seated in the seat 52 would be able to bounce up and down. Also, the infant walkers of FIGS. 1–8 could be motorized so that they would be operable in an automatic mode like the infant walker of FIGS. 9–11. All such variations and modifications are intended to be included within the scope of the invention as defined in the appended claims.

We claim:

1. An infant walker adapted for use in a substantially stationary location on a support surface, such as a floor, comprising a frame having a central axis and an outer circumferential edge; mounting means for mounting said frame above the support surface such that said frame is maintained in a substantially horizontal orientation with its said central axis extending vertically and such that said frame is substantially immovable relative to the support surface, said mounting means including a support rod extending downwardly from said frame along said central axis thereof and a plurality of legs extending outwardly from a lower end of said support rod in engagement with the support surface; supporting means, positioned adjacent to said outer circumferential edge of said frame, for supporting an infant for rotation about an axis of rotation of said supporting means, said supporting means including a seat sized and shaped so as to permit an infant to sit thereon; and suspending means for suspending said seat above the support surface such that an infant in said seat has its legs in engagement with the support surface and such that said seat is revolvable about said central axis of said frame in a circular path which circumscribes said outer circumferential edge of said frame, said suspending means including a sleeve rotatably mounted on said lower end of said support rod, a mounting arm attached to said sleeve, said mounting arm having a first end extending upwardly and outwardly from one side of said sleeve and a second end extending upwardly and outwardly from an opposite side of said sleeve, a counterweight carried by said first end of said mounting arm, and rotating means carried by said second end of said mounting arm for enabling said seat to freely rotate about said axis of rotation of said supporting means, whereby an infant in said seat can walk around said frame along said circular path and/or spin about said axis of rotation.

2. An infant walker according to claim 1, wherein said support rod is adjustable to thereby permit the distance between said frame and the support surface to be varied.

3. An infant walker according to claim 2, wherein said suspending means is motorized, whereby an infant in said seat can be automatically revolved around said frame along said circular path when said frame is at an elevation which inhibits the infant's legs from contacting the support surface.

4. An infant walker according to claim 1, wherein said frame is rotatable about its said central axis.

5. An infant walker according to claim 4, further comprising first locking means for locking said sleeve against rotation relative to said support rod, second locking means for locking said frame against rotation about its said central axis, and third locking means for locking said seat against rotation about said axis of rotation of said supporting means.

6. In an infant walker adapted for use in a substantially stationary location and including a frame, having an opening therein, and mounting means for mounting said frame above a support surface such that said frame is maintained in a substantially horizontal orientation and is substantially immovable relative to a support surface, the improvement comprising supporting means for supporting a plurality of infants above a support surface with their legs in engagement with a support surface, said supporting means including a first seat positioned adjacent to an outer circumferential edge of said frame and a second seat positioned inside said opening in said frame, each of said first and second seats having a size and shape so as to permit an infant to sit thereon; suspending means for suspending said first seat above a support surface such that said first seat is revolvable about said frame; and first rotating means for allowing rotation of said second seat about its own axis of rotation.

7. The improved infant walker of claim 6, further comprising second rotating means for allowing rotation of said first seat about its own axis of rotation.

8. The improved infant walker of claim 7, wherein said frame is an annular tray having said opening centrally located therein.

9. The improved infant walker of claim 8, wherein said mounting means includes a plurality of legs attached to said annular collar.

10. The improved infant walker of claim 9, wherein said suspending means includes a radial member, having a first end attached to said rotating means and a second end revolvably attached to said mounting means, and a roller assembly attached to an upper side of said radial member between said first end thereof and said second end thereof, said roller assembly engaging with an annular track which is attached to a bottom surface of said frame at a position proximate to said outer circumferential edge of said frame.

11. The improved infant walker of claim 10, wherein said second rotating means includes at least one roller bearing race positioned between said radial member and said first seat, whereby said second rotating means maintains said first seat in a horizontal orientation relative to a support surface and said first seat rolls as it rotates relative to said radial member.

12. The improved infant walker of claim 11, wherein said second end of said radial member is revolvably attached around said annular collar and is seated on a flange on a lower end of said annular collar.

13. The improved infant walker of claim 11, wherein said second end of said radial member has an annular ring which encircles said roller bearing race of said first rotating means and is seated on a flange on a lower end of said annular collar.

14. The improved infant walker of claim 8, wherein said annular tray includes first gripping means for allowing an infant in said second seat to grip said tray and second gripping means for allowing an infant in said first seat to grip said tray.

15. The improved infant walker of claim 14, wherein said first gripping means includes an inner circular ridge extending upwardly from an inner circumferential edge of said tray and said second gripping means includes an outer circular ridge extending upwardly from an outer circumferential edge of said tray.

16. The improved infant walker of claim 6, wherein at least one of said first and second seats includes resilient means for enabling said at least one of said first and second seats to reciprocate vertically, whereby an infant seated in said at least one of said first and second seats can bounce up and down.

17. The improved infant walker of claim 16, wherein said resilient means includes a plurality of springs.

18. The improved infant walker of claim 6, wherein said mounting means is adjustable to thereby permit the distance between said frame and a support surface to be varied.

19. The improved infant walker of claim 18, wherein said suspending means is motorized, whereby an infant in said first seat can be automatically revolved about said frame when said frame is at an elevation which inhibits an infant's legs from contacting a support surface.

20. An infant walker adapted for use in a substantially stationary location on a support surface, such as a floor, comprising a base immovably positioned relative to the support surface; a rotatable tray having a central axis and an outer peripheral edge; mounting means for rotatably mounting said tray on said base such that said tray is maintained in a substantially horizontal orientation with its said central axis extending vertically and such that said tray is positioned above the support surface; supporting means, positioned in said tray adjacent to said outer peripheral edge thereof, for supporting an infant for rotation about an axis of rotation of said supporting means, said supporting means including a seat sized and shaped so as to permit an infant to sit thereon; and suspending means for suspending said seat above the support surface such that an infant in said seat has its legs in engagement with the support surface and such that said seat is revolvable about said central axis of said tray in a circular path, said suspending means including rotating means for enabling said seat to freely rotate about said axis of rotation of said supporting means, whereby an infant in said seat can walk along said circular path and/or spin about said axis of rotation.

21. An infant walker according to claim 20, wherein said mounting means includes a spindle extending upwardly from said base along said central axis of said tray, said tray being rotatably mounted on said spindle.

22. An infant walker according to claim 20, wherein said seat of said supporting means is revolvable about said central axis conjointly with said tray.

23. An infant walker according to claim 20, wherein said suspending means includes resilient means for enabling said seat to reciprocate vertically, whereby an infant seated in said seat can bounce up and down.

24. An infant walker according to claim 23, wherein said resilient means includes a plurality of springs.

25. An infant walker according to claim 20, wherein said mounting means is adjustable to thereby permit the distance between said frame and the support surface to be varied.

26. An infant walker according to claim 25, wherein said suspending means is motorized, whereby an infant in said seat can be automatically revolved about said central axis of said tray along said circular path when said frame is at an elevation which inhibits the infant's legs from contacting the support surface.

27. An infant walker according to claim 20, wherein said seat is removable.

28. An infant walker according to claim 27, further comprising an attachment adapted to replace said seat after its removal, said attachment including fastening means for releasably fastening an infant carrier to said attachment.

29. An infant walker adapted for use in a substantially stationary location, comprising a base; mounting means for mounting said base such that said base is substantially immovable relative to the support surface; supporting means for supporting an infant above the support surface with its legs in engagement with the support surface, said supporting means including a seat, said seat having a size and shape so as to permit an infant to sit thereon; and suspending means for suspending said seat above the support surface such that said seat is revolvable about a central vertical axis of said base, said suspending means including rotating means for enabling said seat of said supporting means to rotate relative to said suspending means and resilient means for enabling said seat of said supporting means to reciprocate vertically.

30. An infant walker according to claim 29, wherein said resilient means includes a plurality of springs.

31. An infant walker according to claim 29, wherein said seat is removable.

32. An infant walker according to claim 31, further comprising an attachment adapted to replace said seat after its removal, said attachment including fastening means for releasably fastening an infant carrier to said attachment.

* * * * *